US005769677A

United States Patent [19]

Bell

[11] Patent Number: 5,769,677

[45] Date of Patent: Jun. 23, 1998

[54] MARKER BUOY

[75] Inventor: Richard E. Bell, Corpus Christi, Tex.

[73] Assignee: The United States of America as represented by the Secretary of the Navy, Washington, D.C.

[21] Appl. No.: 794,522

[22] Filed: Feb. 3, 1997

[51] Int. Cl.[6] ..... B63B 22/18

[52] U.S. Cl. ..... 441/24; 441/28

[58] Field of Search ..... 441/6, 21, 23, 441/24, 25, 26, 27, 28; 114/326

[56] References Cited

U.S. PATENT DOCUMENTS

| | | | |
|---|---|---|---|
| 2,562,922 | 8/1951 | Kist | 441/24 |
| 3,121,889 | 2/1964 | Gentile | 441/24 |
| 3,212,110 | 10/1965 | Lombardo | 441/24 |
| 4,443,203 | 4/1984 | Maertens | 441/22 |

*Primary Examiner*—Sherman Basinger
*Attorney, Agent, or Firm*—Harvey A. Gilbert

[57] ABSTRACT

A marker buoy includes a base with a post coupled to and extending therefrom, a line attached to the post and is wrapped about a portion thereof, and a float attached to the line and fitted over the wrapped portion of the post. When the marker buoy is deployed near the bottom of a body of water, the base sinks to the bottom and the float rises to the surface of the body of water causing the line to unwrap from the post. The line length is user set as a function of depth and speed of the surface current at the time of buoy placement and use.

17 Claims, 2 Drawing Sheets

MARKER BUOY

ORIGIN OF THE INVENTION

The invention described herein was made in the performance of official duties by an employee of the Department of the Navy and may be manufactured, used, licensed by or for the Government for any governmental purpose without payment of any royalties thereon.

FIELD OF THE INVENTION

The invention relates generally to a buoy, and more particularly to a marker buoy that floats at the water's surface to accurately identify the location of objects, e.g., mines, wreckage, etc. residing under the water's surface.

BACKGROUND OF THE INVENTION

A variety of applications require the accurate marking of the location of an object under the water's surface such that the location can be noted from the water's surface. For example, in salvage or search and recovery missions of sunken ships or downed aircraft, it is imperative that the search and recovery vessel get the search and recovery divers as close to the objects as possible. This minimizes the amount of time a diver must spend looking for the object so that the diver's at-depth time can be efficiently utilized. Proper marking at the surface also identifies where divers will be working should a diver require assistance. This is especially important when operating in water with low-visibility.

Reconnaissance or neutralization operations involving moored or bottom-deployed mines also require accurate marking at the water's surface. Once accurately marked, the mines can be avoided or efficiently neutralized. It is desirable that such marking be visually apparent at the water's surface for ease of navigation therearound, for video recording thereof, etc. Finally, and most importantly, the marking of mines is ideally accomplished without requiring personnel to operate in the vicinity of the mines.

In searching the prior art, U.S. Pat. No. 4,443,203 to Maertens and the patents cited therein were noted.

SUMMARY OF THE INVENTION

Accordingly, it is an object of the present invention to provide a marker buoy that, once deployed near an underwater object, accurately marks the location of the underwater object at the water's surface.

Another object of the present invention is to provide a marker buoy that lends itself to being deployed underwater without requiring personnel in the vicinity of such deployment.

Other objects and advantages of the present invention will become more obvious hereinafter in the specification and drawings.

In accordance with the present invention, a marker buoy has a base with a post coupled to and extending therefrom. A line is attached at a first end thereof to the post (or base) and is wrapped about a portion of the post. A float is attached to a second end of the line and is fitted over the wrapped portion of the post. When the marker buoy is deployed near the bottom of a body of water, the base sinks to the bottom and the float rises to the surface of the body of water causing the line to unwrap from the post.

DETAILED DESCRIPTION OF THE INVENTION

Figure 1:
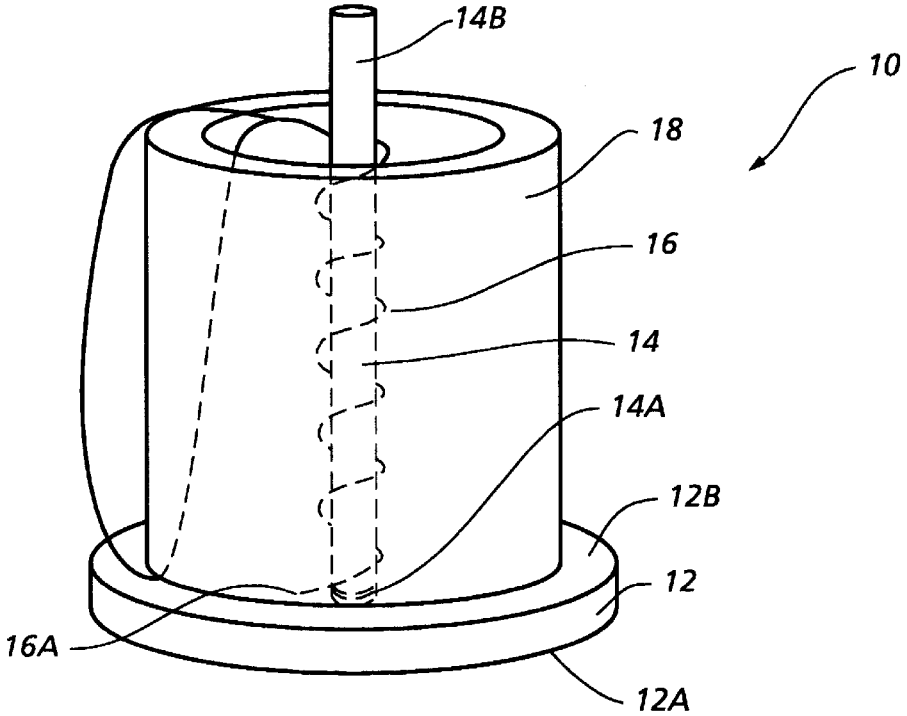
FIG. 1 is a perspective view of a preferred embodiment marker buoy prior to its deployment in accordance with the present invention.

Referring now to the drawings, and more particularly to FIG. 1, a marker buoy according to the present invention is shown and referenced generally by number 10. Marker buoy 10 is depicted as it would appear prior to deployment. In general, marker buoy 10 includes a base 12, a wrapping post 14 attached to or integral with base 12, a line 16 wrapped about post 14, and a float 18. Line 16 is attached at one end 16A to either base 12 near post 14 or post 14 itself, and is attached at its other end to float 18. Note that the attachment of line 16 to float 18 is somewhat dependent on the construction of float 18. In general, line 16 should be attached to float 18 such that it does not tangle or snag when float 18 assumes its natural buoyant orientation upon deployment. For example, if float 18 is a hollow cylinder open at either end, line 16 can be threaded through float 18 and tied-off to itself as illustrated in FIG. 1. Regardless of the attachment configuration, line 16 is wrapped about post 14 between its two attached ends.

More specifically, base 12 is a weighted base, e.g., lead, a plastic shell filled with sand, etc., having a bottom surface 12A that allows base 12 to be stable on a foundation such as the bottom of a body of water. By way of a simple example, base 12 is shown as a disk having a flat bottom surface 12A. However, base 12 could be otherwise shaped to suit a particular type of bottom, e.g., sloped, rocky, etc.

As mentioned above, post 14 can be attached to or formed integral with base 12. Post 14 is typically made from cylindrical stock to facilitate wrapping and unwrapping of line 16. Suitable materials could include rigid materials such as metals, plastics, composites, etc., or flexible materials for reasons that will be described further below. If attachment of post 14 to base 12 is required, post 14 could be threaded at end 14A and screw tapped into base 12 as shown (or could be passed through base 12 and bolted thereto). Regardless of construction of base 12 and post 14, the combined structure of base 12 and post 14 should be such that when base 12 rests on the bottom of a body of water, post 14 assumes an approximately normal or perpendicular orientation to the water's surface above (as line 16 is unwrapped from post 14). For the illustrated embodiment of base 12 having flat bottom surface 12A and flat top surface 12B, post 14 extends substantially perpendicular with respect to base 12.

Since line 16 may be several hundred feet or more in length, it should be strong and preferably of small diameter in order to minimize the diameter of wrapped line 16 about post 14. In addition, line 16 is preferable made of a non-elastic material so that once wrapped about post 14, line 16 will not tend to "spring" away from post 14. Once line 16 is wrapped about post 14, it can be lightly tacked in place. Since line 16 is non-elastic, only minimal tacking is required. An example of a suitable line 16 is ⅛ inch diameter shot line available commercially from FWF Industries Inc., Lincoln, R.I. The length of line 16 is a function of the depth of the water and the speed of the surface current where marker buoy 10 is to be deployed. The length L of line 16 can be determined in accordance with $$L=(1.25*A)*(0.05*B)+(1.25*A)$$

where A is the depth of the water where marker buoy 10 is deployed and B is the speed of the surface current where marker buoy 10 is deployed. Both of these quantities are easily measured from onboard a mother ship floating on the water's surface. The depth multiplier (i.e., 1.25) was selected to provide enough line 16 to allow float 18 to reach the water's surface in the presence of any amount of surface current. The depth multiplier also provides enough line 16 to be tied-off at either end thereof to float 18 and base 12 or post 14. Accordingly, the depth multiplier can be slightly adjusted to account for various tie-off configurations.

Float 18 can be made from any float material that can withstand the pressure at the depth of the body of water where marker buoy 10 will be deployed. In the illustrated embodiment, float 18 is a hollow float that fits over or encircles post 14 wrapped with line 16 and rests on base 12 prior to deployment. This configuration protects line 16 in its wrapped configuration and also allows float 18 to be centered with respect to post 14. Such centering facilitates the unwrapping of line 16 once marker buoy 10 is deployed as will be explained further below.

As mentioned above, it is desirable in some applications to deploy marker buoy 10 without the use of personnel in the vicinity of deployment. For example, in mine reconnaissance, the Navy uses a remotely-controlled, unmanned submersible (e.g., the mine neutralization system AN/SLQ-48 (V)) to locate, classify and neutralize moored and bottom-deployed mines. This submersible includes cable-cutting arms that can be utilized as clamps. Accordingly, in the illustrated embodiment of marker buoy 10, post 14 includes an unwrapped portion 14B that extends beyond float 18 as shown. In this way, the cable-cutting arms (not shown) of the above-cited Navy submersible can extend over float 18 and clamp onto unwrapped post portion 14B thereby retaining float 18 in position until deployment. In addition, unwrapped post portion 14B serves as a suitable carrying point when marker buoy 10 must be handled prior to deployment.

Figure 2:
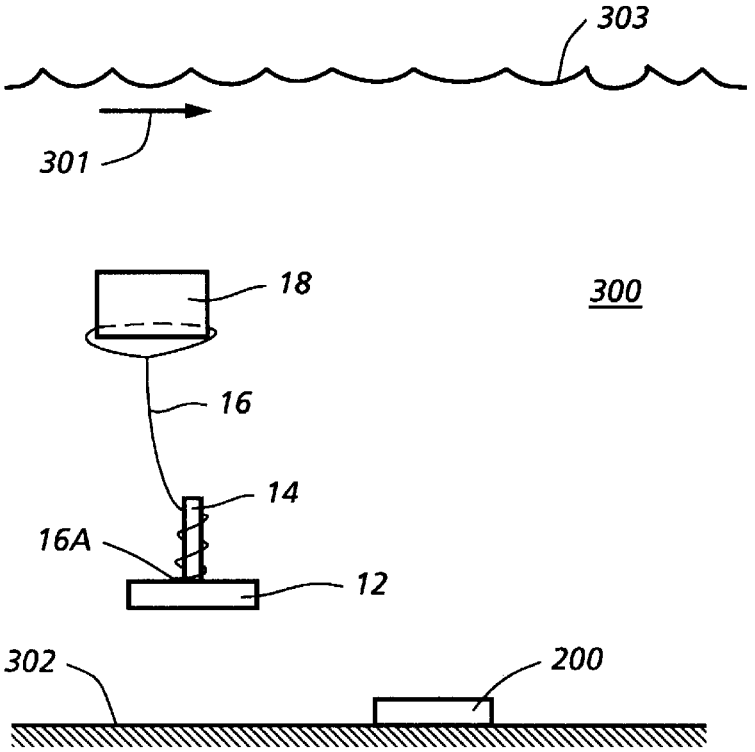
FIG. 2 depicts schematically the marker buoy shortly after deployment near an object to be marked at the bottom of a body of water.
Figure 3:
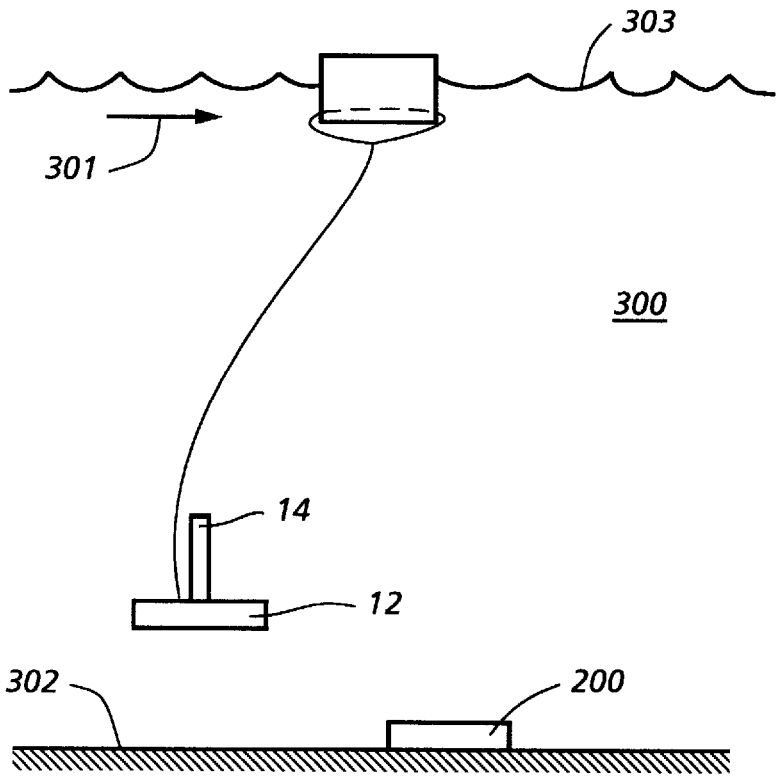
FIG. 3 depicts schematically the marker buoy after the line has been fully deployed.

Use of the present invention to mark the location of an object at the bottom of a body of water will now be described with the aid of FIGS. 2 and 3. In FIG. 2, the marker buoy is transported underwater by, for example, an unmanned submersible (not shown) such as described above. Once in a position upstream of an object 200, the submersible releases marker the buoy and leaves the vicinity. Upstream is defined herein with respect to the direction of the surface current indicated in FIGS. 2 and 3 by arrow 301. As base 12 sinks toward the bottom 302 of the body of water 300, float 18 rises toward the surface 303. Since float 18 is centered over post 14 wrapped with line 16, the initial payout of line 16 will not bind or snag. Note that since deployment is near bottom 302, base 12 will come to rest on bottom 302 before float 18 reaches surface 303. However, this presents no problems with the unwrapping of line 16 since base 12 and post 14 define a combined structure that positions post 14 approximately perpendicular to surface 303. When line 16 is fully deployed, float 18 is visible on surface 303 and base 12 rests on bottom 302 as shown in FIG. 3. The position of base 12 relative to object 200, and the amount of offset between base 12 and object 200, are selected based on the amount of surface current 301 so that at the water's surface, float 18 is approximately directly over object 200.

The advantages of the present invention are numerous. The marker buoy can be utilized for any mission requiring precise underwater marking. It provides a visually verifiable, precise buoy marking system that can be recorded on video tape. When deployed by an unmanned submersible, it eliminates the risk of human life in order to mark mines. Thus, the benefits to the diver community in salvage and mine neutralization operations are enormous.

Although the invention has been described relative to a specific embodiment thereof, there are numerous variations and modifications that will be readily apparent to those skilled in the art in light of the above teachings. For example, if post 14 was made of a flexible material, the forces applied thereto as float 18 rose to the water's surface would tend to flex post 14 towards a substantially perpendicular orientation with respect to the water's surface. In this way, a margin of error could be tolerated between the orientation of base 12 on the bottom of the water. It is therefore to be understood that, within the scope of the appended claims, the invention may be practiced other than as specifically described.

What is claimed as new and desired to be secured by Letters Patent of the United States is:

1. A marker buoy, comprising:

a base;

a post made of flexible material coupled to and extending from said base;

a line attached at a first end thereof to said post and wrapped about a portion of said post; and a float attached to a second end of said line wherein, when said marker buoy is deployed near the bottom of a body of water, said base sinks to the bottom and said float rises to the surface of said body of water causing said line to unwrap from said post and causing said post to flex towards a substantially perpendicular orientation with respect to the surface of said body of water.

2. A marker buoy as in claim 1 wherein said base is shaped to position said post approximately perpendicular to the surface of said body of water when said base comes to rest on the bottom of said body of water.

3. A marker buoy as in claim 1 wherein said base has a flat bottom.

4. A marker buoy as in claim 1 wherein said post is cylindrical.

5. A marker buoy as in claim 1 wherein said line is non-elastic.

6. A marker buoy as in claim 1 wherein said line has a length L equal to (1.25*A)*(0.05*B)+(1.25*A) where A is the depth of said body of water where said marker buoy is deployed and B is the speed of the current at the surface of said body of water,where said marker buoy is deployed.

7. A marker buoy as in claim 1 wherein said float is hollow, and wherein said float encircles said post wrapped with said line.

8. A marker buoy as in claim 7 wherein said post extends beyond said float when said float encircles said post wrapped with said line.

9. A marker buoy, comprising:

a weighted base having a cylindrical portion extending substantially perpendicular therefrom;

a line attached at a first end thereof to said weighted base and wrapped about a portion of said cylindrical portion;

a float attached to a second end of said line, said float encircling said cylindrical portion wrapped with said line and resting on said weighted base wherein said cylindrical portion extends beyond said float when said float is resting on said weighted base and wherein, when said marker buoy is deployed near the bottom of a body of water, said weighted base sinks to the bottom and said float rises to the surface of said body of water causing said line to unwrap from said cylindrical portion; and said line having a length L that is a function of the depth of said body of water where said marker buoy is deployed and the speed of the current at the surface of said body of water where said marker buoy is deployed.

10. A marker buoy as in claim 9 wherein said weighted base has a bottom surface that is flat.

11. A marker buoy as in claim 9 wherein said cylindrical portion is flexible.

12. A marker buoy as in claim 9 wherein said line is non-elastic.

13. A marker buoy as in claim 9 wherein said length L is equal to (1.25*A)*(0.05*B)+(1.25*A) where A is the depth of said body of water where said marker buoy is deployed and B is the speed of the current at the surface of said body of water where said marker buoy is deployed.

14. A marker buoy, comprising:

a weighted base;

a post attached to a central portion of said weighted base and extending substantially perpendicularly away from said weighted base;

a non-elastic line attached at a first end thereof to and wrapped about a portion of said post;

a hollow float attached to a second end of said non-elastic line, said-hollow float encircling said post wrapped with said non-elastic line and resting on said weighted base wherein, when said marker buoy is deployed near the bottom of a body of water, said weighted base sinks to the bottom and said hollow float rises to the surface of said body of water causing said line to unwrap from said post, said hollow float further being shorter in length than said post wherein said post extends beyond said hollow float when said hollow float is resting on said weighted base and encircles said portion of said post wrapped with said line; and said non-elastic line having a length L that is a function of the depth of said body of water where said marker buoy is deployed and the speed of the current at the surface of said body of water where said marker buoy is deployed.

15. A marker buoy as in claim 14 wherein said weighted base has a bottom shaped to position said post approximately perpendicular to the surface of said body of water when said weighted base comes to rest on the bottom of said body of water.

16. A marker buoy as in claim 14, wherein said post is flexible.

17. A marker buoy as in claim 14 wherein said length L is equal to (1.25*A)*(0.05*B)+(1.25*A) where A is the depth of said body of water where said marker buoy is deployed and B is the speed of the current at the surface of said body of water where said marker buoy is deployed.

* * * * *